US009825409B1

(12) United States Patent
Kameyama

(10) Patent No.: US 9,825,409 B1
(45) Date of Patent: Nov. 21, 2017

(54) SHIELD CONNECTOR AND METHOD FOR ASSEMBLING SHIELD CONNECTOR

(71) Applicant: YAZAKI CORPORATION, Tokyo (JP)

(72) Inventor: Isao Kameyama, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/615,939

(22) Filed: Jun. 7, 2017

(30) Foreign Application Priority Data

Jun. 23, 2016 (JP) ..... 2016-124204

(51) Int. Cl.
*H01R 13/6597* (2011.01)
*H01R 24/86* (2011.01)
*H01R 24/40* (2011.01)

(52) U.S. Cl.
CPC ..... *H01R 13/6597* (2013.01); *H01R 24/40* (2013.01); *H01R 24/86* (2013.01)

(58) Field of Classification Search
CPC ..... H01R 9/24; H01R 9/2675; H01R 31/02; H01R 23/65802; H01R 23/688
USPC ..... 439/709, 715, 712, 171, 607.1, 607.08
See application file for complete search history.

(56) References Cited

U.S. PATENT DOCUMENTS 8,430,692 B2 * 4/2013 Peng ..... H01R 13/518 439/607.46
8,550,828 B2 * 10/2013 Liao ..... H01R 27/02 439/131
8,764,486 B2 7/2014 Ii
8,992,257 B2 * 3/2015 Ii ..... H01R 13/59 439/607.41
9,281,628 B2 * 3/2016 Wu ..... H01R 13/6582
9,472,907 B2 * 10/2016 Kao ..... H01R 13/6595
2013/0023154 A1 1/2013 Ii
2013/0023155 A1 * 1/2013 Ii ..... H01R 13/6593 439/607.27

FOREIGN PATENT DOCUMENTS

JP 2009-283325 A 12/2009
JP 2013-25956 A 2/2013

* cited by examiner

*Primary Examiner* — Phuong Chi T Nguyen
(74) *Attorney, Agent, or Firm* — Sughrue Mion, PLLC

(57) ABSTRACT

A shield connector includes an inner housing provided with a first terminal receiving chamber and a second terminal receiving chamber which are configured to respectively receive inner terminals attached to ends of a plurality of wires bundled into a shielded electric wire, and a shield terminal incorporating the inner housing therein. The first terminal receiving chamber is provided with an opening which is opened to a side opposite to a side where the second terminal receiving chamber is placed. The opening is opened, from one end of the first terminal receiving chamber at a side of a terminal insertion port of the second terminal receiving chamber through which one of the inner terminals is inserted, to a wall at the other end of the first terminal receiving chamber, so that another one of the inner terminals is received in the first terminal receiving chamber through the opening.

6 Claims, 11 Drawing Sheets

SHIELD CONNECTOR AND METHOD FOR ASSEMBLING SHIELD CONNECTOR

CROSS REFERENCE TO RELATED APPLICATIONS

This application is based on Japanese Patent Application (No. 2016-124204) filed on Jun. 23, 2016, the contents of which are incorporated herein by way of reference.

BACKGROUND

The present invention relates to a shield connector configured to have an inner housing provided with plural terminal receiving chambers for respectively receiving plural inner terminals of a shielded electric wire and a shield terminal into which the inner housing is incorporated, and a method for assembling the shield connector.

Conventionally, a high-frequency-capable shielded electric wire is used for transmitting a high-frequency electrical signal to a control part of various electrical components such as a car navigator mounted in a vehicle etc.

The shielded electric wire has a structure in which an outer periphery of an insulating coating formed by coating an outer periphery of a conductor part made of a conductive material is covered with a shielding layer, and the shielding layer arranged in an outer surface can block an electrical influence from the outside to thereby perform high-frequency propagation.

Also, the shielded electric wire includes a shielded electric wire bundled by covering outer peripheries of plural electric wires with a coating material including a shielding material and an insulating material.

A shield connector is used for electrical connection of the shielded electric wire formed by bundling the plural electric wires with the coating material in this manner.

The shield connector is configured to have an inner housing provided with plural terminal receiving chambers for receiving each inner terminal attached to a distal end of each of the electric wires, and a shield terminal into which the inner housing is incorporated.

Incidentally, a cable called a composite cable like the shielded electric wire formed by bundling the plural electric wires with the coating material has a problem of being difficult to receive the terminal attached to the distal end of each of the electric wires in the terminal receiving chamber when the length of each of the electric wires exposed from the coating material is short.

Particularly, the shielded electric wire is adjusted so that the length of each of the electric wires exposed from the coating material becomes short so as to decrease exposure from the coating material including the shielding material in order not to decrease an electromagnetic shielding effect.

As a result, Patent Documents 1 and 2 propose a technique capable of easily receiving a terminal attached to a distal end of each of the electric wires in a corresponding terminal receiving chamber even when the length of each of the electric wires exposed by removing a coating material of a distal end of a composite cable is short.

Since a connector described in Patent Document 1 is constructed so that plural crimping terminals (terminals) can be collectively attached to a case after the crimping terminals (terminals) are respectively attached to a side part of a housing, the connector is constructed so that an extra length ranging from a crimp part of the crimping terminal (terminal) to a distal end (distal end of the coating material) of a cabtire of the composite cable can be shortened.

In a shield connector and a method for assembling the shield connector described in Patent Document 2, the terminals can be respectively inserted into the terminal receiving chambers of divided inner housings every plural small terminal groups, with the result that work of insertion of each of the terminals into the corresponding terminal receiving chamber can easily be done even when the length of each of the electric wires exposed by removing the coating material of the distal end is short.

[Patent Document 1] JP 2009-283325 A

[Patent Document 2] JP 2013-25956 A

SUMMARY

An object of the invention is to provide a shield connector and a method for assembling the shield connector capable of easily automating an assembling step.

According to one advantageous effect of the present invention, there is provided a shield connector, including:

an inner housing provided with a first terminal receiving chamber and a second terminal receiving chamber which are configured to respectively receive inner terminals attached to ends of a plurality of wires bundled into a shielded electric wire; and a shield terminal incorporating the inner housing therein, wherein the first terminal receiving chamber is provided with an opening which is opened to a side opposite to a side where the second terminal receiving chamber is placed, and the opening is opened, from one end of the first terminal receiving chamber at a side of a terminal insertion port of the second terminal receiving chamber through which one of the inner terminals is inserted, to a wall at the other end of the first terminal receiving chamber, so that another one of the inner terminals is received in the first terminal receiving chamber through the opening.

The first terminal receiving chamber and the second terminal receiving chamber may be configured to receive the inner terminals each of which includes a mating terminal connecting part having a cylindrical shape and configured to be connected to an mating terminal.

The shield connector may be configured such that the inner housing includes an upper step provided with the first terminal receiving chamber and a lower step provided with the second terminal receiving chamber, a plurality of upper terminal receiving chambers including the first terminal receiving chamber are provided in the upper step, a plurality of lower terminal receiving chambers including the second terminal receiving chamber are provided in the lower step, and each of the upper terminal receiving chambers is provided with the opening.

According to one advantageous effect of the present invention, there is provided a method for assembling a shield connector, wherein the shield connector includes:

an inner housing provided with a first terminal receiving chamber and a second terminal receiving chamber which are configured to respectively receive inner terminals attached to ends of a plurality of wires bundled into a shielded electric wire; and a shield terminal incorporating the inner housing therein, wherein the first terminal receiving chamber is provided with an opening which is opened to a side opposite to a side where the second terminal receiving chamber is placed, and the opening is opened, from one end of the first terminal receiving chamber at a side of a terminal insertion port of the second terminal receiving chamber through which one of the inner terminals is inserted, to a wall at the other end of the first terminal receiving chamber, the method for assembling the shield connector including:

bending a first one of the wires from a straight state;

inserting the one of the inner terminals attached to a second one of the wires from the terminal insertion port so that the one of the inner terminals is received in the second terminal receiving chamber in a state that the first one of the wires is bent by the bending; and deforming the first one of the wires into the straight state from the state that the first one of the wires is bent, while inserting another one of the inner terminals attached to the first one of the wires into the first terminal receiving chamber through the opening, in a state that the one of the inner terminals is received in the second terminal receiving chamber.

The method for assembling the shield connector may further include:

before the bending of the first one of the wires, bending the second one of the wires from a straight state while maintaining the first one of the wires in straight, and attaching another one of the inner terminals to the first one of the wires in a state that the second one of the wires is bent; and after the bending of the first one of the wires and before the inserting of the one of the inner terminals, deforming the second one of the wires into the straight state from a state that the second one of the wires is bent, and attaching the one of the inner terminals to the second one of the wires in a state that the second one of the wires is in the straight state.

The method for assembling the shield connector may further include:

inserting the inner housing into the shield terminal in a state that all of the inner terminals are received in the inner housing.

DETAILED DESCRIPTION FOR EXEMPLIFIED EMBODIMENTS

In the connector described in Patent Reference 1, each of the electric wires exposed from the distal end of the cabtire must be spread around a center position of a branch and must be bent so as to insert a top end of an engaging part into an engaged part, and the number of man-hours necessary to set the terminals is increased and an assembling step becomes complicated. As a result, there is a problem of becoming difficult to automate the assembling step.

Also, in the shield connector and the method for assembling the shield connector described in Patent Reference 2, the inner housings are divided into an upper inner housing and a lower inner housing, with the result that these inner housings must be separated at the time of inserting the terminals and these inner housings must be united at the time of the completion of insertion of the terminals and an assembling step becomes complicated. As a result, there is a problem of becoming difficult to automate the assembling step.

The invention has been implemented in view of the above, and an object of the invention is to propose a shield connector capable of easily automating an assembling step, and a method for assembling the shield connector.

Embodiments of a shield connector and a method for assembling the shield connector according to the invention will hereinafter be described in detail with reference to the drawings.

Figure 1:
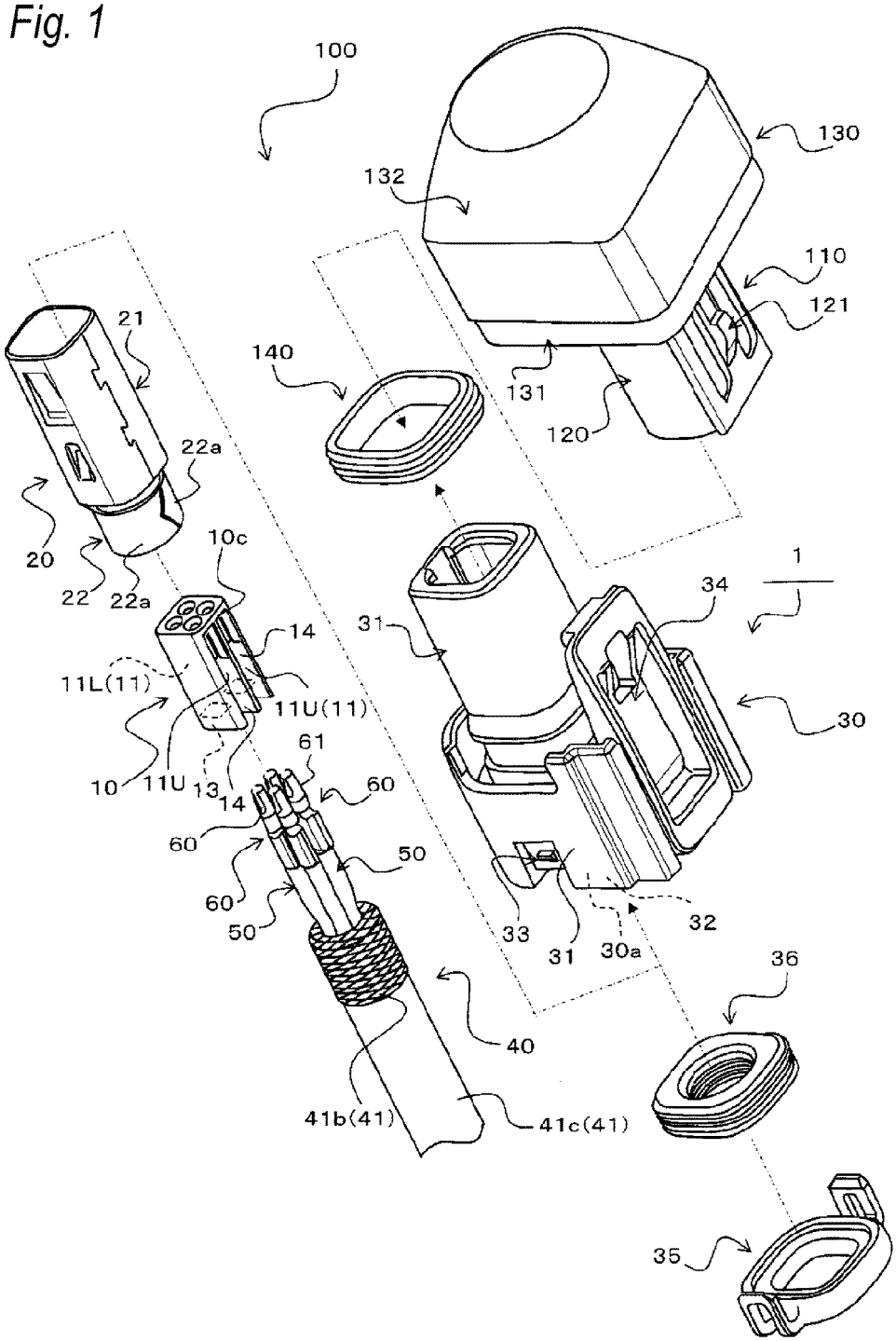
FIG. 1 is an exploded perspective view of a vehicle-mounted camera into which a shield connector according to an embodiment of the invention is incorporated.
Figure 2A:
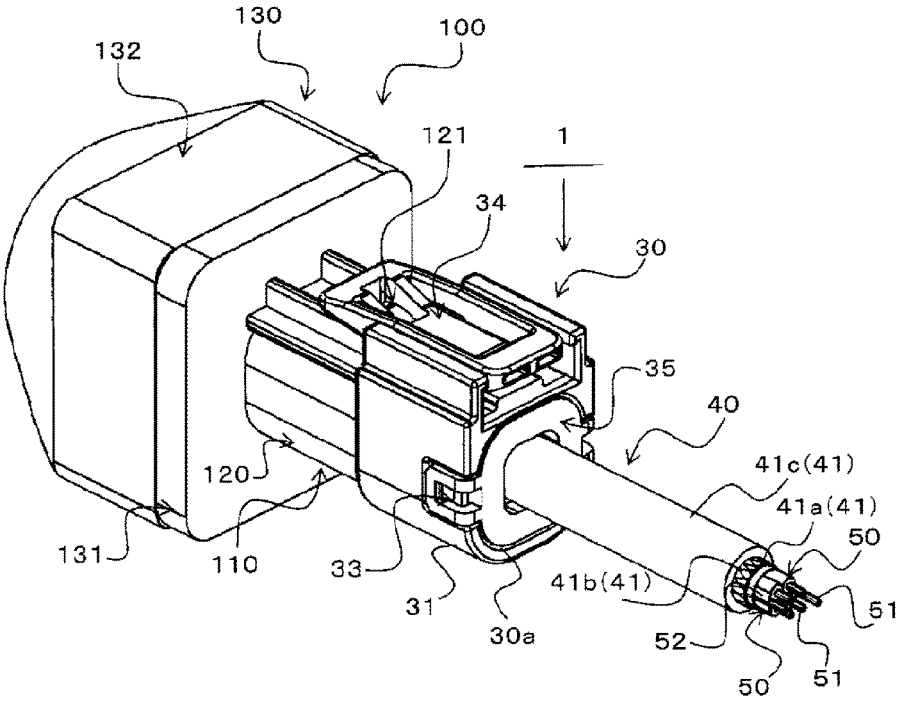
FIG. 2A is a perspective view of the vehicle-mounted camera in the case of being viewed from the side of an electric wire pullout port of an outer housing.
Figure 2B:
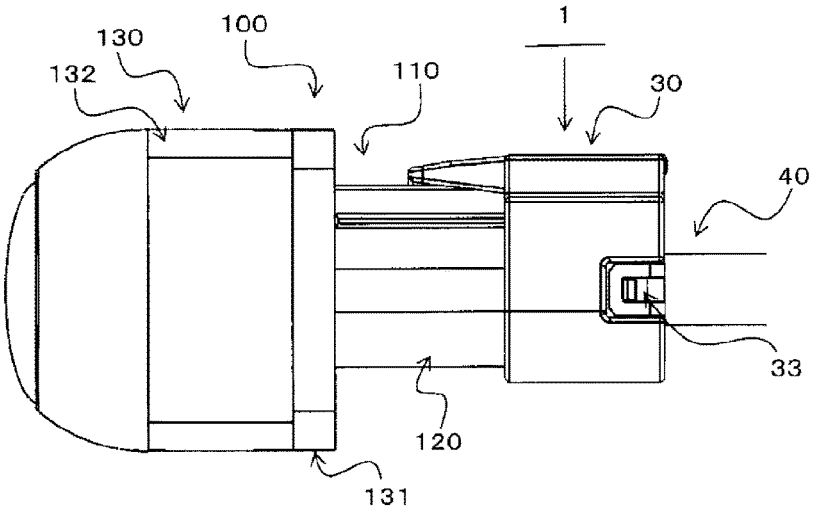
FIG. 2B is a side view of the vehicle-mounted camera.
Figure 3A:
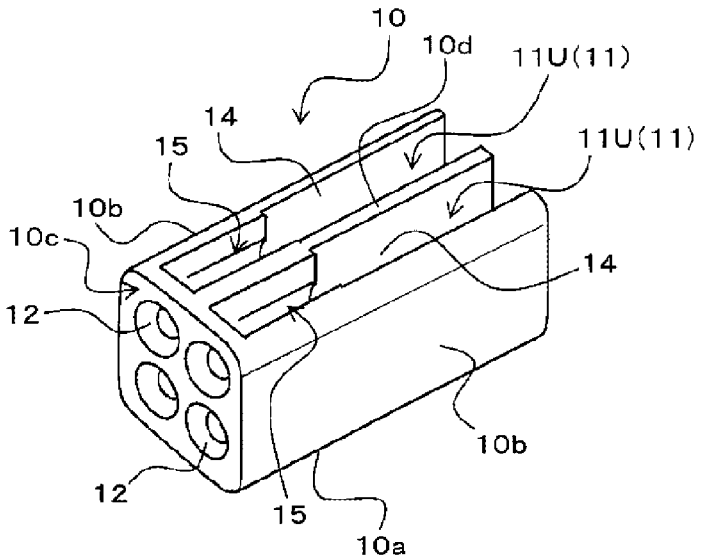
FIG. 3A is a perspective view of an inner housing in the case of being viewed from the side of a mating terminal insertion port.
Figure 3B:
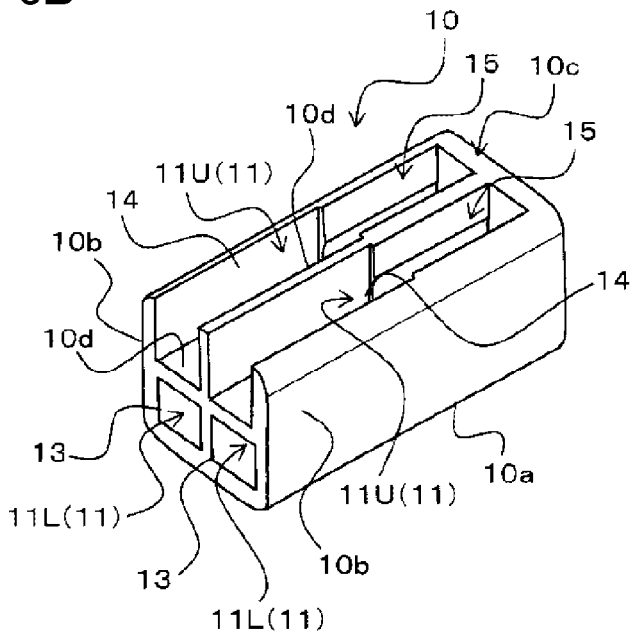
FIG. 3B is a perspective view of an inner terminal in the case of being viewed from the side of a terminal insertion port.
Figure 3C:
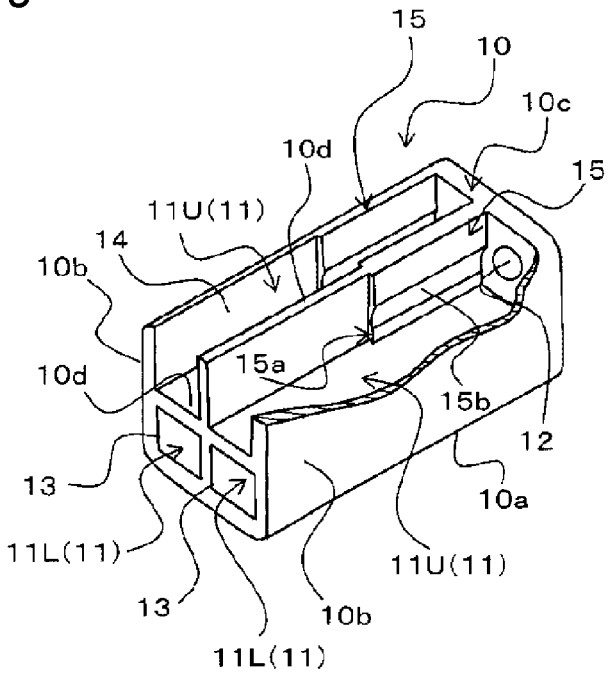
FIG. 3C is a partially sectional view of the inner housing shown in FIG. 3B.
Figure 4:
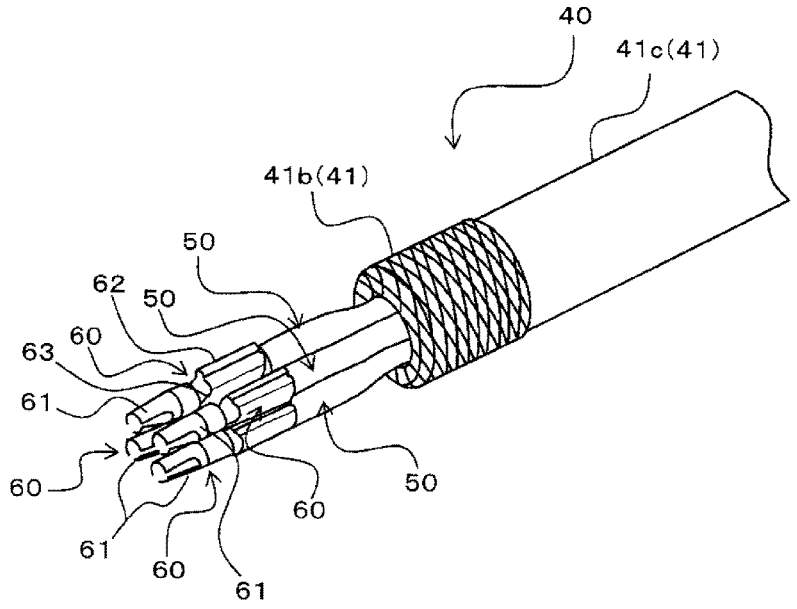
FIG. 4 is an enlarged view of a shielded electric wire shown in FIG. 1.

FIG. 1 is an exploded perspective view of a vehicle-mounted camera 100 into which a shield connector 1 according to an embodiment of the invention is incorporated. FIG. 2A is a perspective view of the vehicle-mounted camera 100 in the case of being viewed from the side of an electric wire pullout port 30*a* of an outer housing 30, and FIG. 2B is a side view of the vehicle-mounted camera 100. FIG. 3A is a perspective view of an inner housing 10 in the case of being viewed from the side of an mating terminal insertion port 12, and FIG. 3B is a perspective view of an inner terminal 60 in the case of being viewed from the side of a terminal insertion port 13, and FIG. 3C is a partially sectional view of the inner housing 10 shown in FIG. 3B. FIG. 4 is an enlarged view of a shielded electric wire 40 shown in FIG. 1.

The shield connector 1 according to the embodiment of the invention is used for, for example, electrical connection of the vehicle-mounted camera 100.

As a result, the shield connector 1 is connector-fitted into a connection other connector 110 with a camera functional component (not shown) received to thereby configure the vehicle-mounted camera 100 as shown in FIGS. 2A and 2B.

The shield connector 1 is configured to have the inner housing 10 provided with plural terminal receiving chambers 11 for respectively receiving the inner terminals 60 of the shielded electric wire 40 bundled by covering outer peripheries of plural electric wires 50 in which the inner terminals 60 are attached to the distal ends with a coating material 41 including a shielding material and an insulating material, a shield terminal 20 attached to the inner housing so as to cover an outer periphery of the inner housing 10, and the outer housing 30 which internally receives the inner housing 10 with the shield terminal 20 attached and is provided with a connector fitting portion into the connection other connector 110.

In addition, a rubber stopper 36 as a waterproof seal member is fixed to a back end opening of the outer housing 30 by a holder 35.

Such a shield connector 1 is connector-fitted into the connection other connector 110 so as to be able to be made waterproof by arranging packing 140 between the connection other connector 110 and the shield connector 1.

The shielded electric wire 40 is constructed by covering the plural electric wires 50 with the multi-layer coating material 41.

More concretely, as shown in FIG. 2A, the four electric wires 50 are covered with metal foil 41*a* so as to be bundled, and an outer periphery of the metal foil 41*a* is further covered with a braid 41*b* braided by a conductive material, and an outer periphery of the braid 41*b* is further covered with an insulating coating material 41*c* to thereby construct this shielded electric wire 40.

Also, as shown in FIG. 4, in the shielded electric wire 40, the four electric wires 50 are exposed to distal ends, and the inner terminal 60 is crimped to the exposed distal end of each of the electric wires 50.

More concretely, in the shielded electric wire 40, the insulating coating material 41*c* of the distal end is removed, and the braid 41*b* exposed to a lower layer of the insulating coating material 41*c* is folded back so as to overlap with an outer periphery of the insulating coating material 41*c*, and the metal foil 41*a* exposed to a lower layer of the braid 41*b* is removed to thereby expose each of the electric wires 50 from the coating material 41. The inner terminal 60 is attached to the distal end of each of the electric wires 50 in a state in which an insulating coating material 52 of this exposed distal end of each of the electric wires 50 is removed and a conductor part 51 is exposed.

In addition, the length in which each of the electric wires 50 is exposed from the coating material 41 is adjusted short in order not to decrease an electromagnetic shielding effect by the metal foil 41*a* or the braid 41*b*.

The inner terminal 60 is a female terminal, and is configured to have a cylindrical mating terminal connecting part 61 to which a connection mating terminal of the connection other connector 110 is connected, a crimp part 62 crimped to the electric wire 50, and a joining part 63 for joining the mating terminal connecting part 61 to the crimp part 62 so that bottom walls continue.

As shown in FIGS. 3A to 3C, the inner housing 10 has a block shape made of an insulating resin material, and four terminal receiving chambers 11 are formed in two upper and lower steps, and an upper surface of the terminal receiving chamber 11U of the upper step is provided with an opening 14 for upper step side terminal reception, the opening 14 being opened from one end face used as the side of the terminal insertion port 13 of the inner terminal 60 in the terminal receiving chamber 11L of the lower step to a wall forming the other opposed end face so that the inner terminal 60 can be internally received.

More concretely, an outer wall of the inner housing 10 is constructed of a bottom wall 10*a*, a pair of side walls 10*b*, 10*b* erected on both side ends of the bottom wall 10*a*, and a front end wall 10*c* erected on the end of the side connected to the connection mating terminal in the bottom wall 10*a*, and an outer shell of the inner housing 10 has substantially a rectangular parallelepiped shape.

Also, the inside of space formed by the bottom wall 10*a*, the pair of side walls 10*b*, 10*b* and the front end wall 10*c* is provided with partition walls 10*d* so as to respectively divide the space into two pieces in a vertical direction and a lateral direction to thereby form the terminal receiving chambers 11 in two upper and lower steps two by two, respectively. In addition, the terminal receiving chamber 11L of the lower step and the terminal receiving chamber 11U of the upper step may be just one chamber respectively.

The front end wall 10*c* is provided with each of the mating terminal insertion ports 12 in a position corresponding to each of the terminal receiving chambers 11 so that the connection mating terminal can be connected to the inner terminal 60 received in each of the terminal receiving chambers 11.

In the two terminal receiving chambers 11 of the lower step, space capable of receiving the inner terminal 60 is formed by the bottom wall 10*a*, the side wall 10*b*, the front end wall 10*c* and the partition wall 10*d*, and an end face opposed to the front end wall 10*c* is provided with the terminal insertion port 13 of the inner terminal 60. The numeral of the two terminal receiving chambers 11 of the lower step is hereinafter set at "11L" in the case of being distinguished from the terminal receiving chambers of the upper step.

In the two terminal receiving chambers 11 of the upper step, space capable of receiving the inner terminal 60 is formed by the side wall 10*b*, the front end wall 10*c* and the partition wall 10*d*, and the opening 14 for upper step side terminal reception are formed. The numeral of the two terminal receiving chambers 11 of the upper step is hereinafter set at "11U" in the case of being distinguished from the terminal receiving chambers of the lower step. The opening 14 is opened from one end face used as the side of the terminal insertion port 13 of the inner terminal 60 in the terminal receiving chamber 11L of the lower step to the wall (front end wall) 10*c* forming the other opposed end face so that the inner terminal 60 can be internally received. In other words, the opening 14 is opened to a side opposite to a side where the terminal receiving chamber 11L of the lower step is placed.

Also, each of the terminal receiving chambers 11 is provided with a terminal holding part 15 for holding the inner terminal 60 in a predetermined position of the inside of the terminal receiving chamber 11.

As shown in FIG. 3C, the terminal holding part 15 is configured to have step wall parts 15*a* in which both side surfaces of the inside of the terminal receiving chamber 11 are inwardly projected in step shapes so as to narrow a lateral width of space of the inside of the terminal receiving chamber 11 in a position in which the mating terminal connecting part 61 of the inner terminal 60 is arranged, and curved recessed parts 15*b* in which the step wall parts 15*a* are formed with recesses in curved shapes so as to correspond to an outer periphery of the mating terminal connecting part 61.

Such a terminal holding part 15 performs a function of positioning the mating terminal connecting part 61 of the inner terminal 60 inserted into the terminal receiving chamber 11L of the lower step from the terminal insertion port 13 in a position connected to a connection mating terminal inserted from the mating terminal insertion port 12, and also performs a function of making the inner terminal 60 resistant to coming out of the terminal insertion port 13 by decreasing a gap between the connection mating terminal and an inner surface of the terminal receiving chamber 11L.

Also, the terminal holding part 15 performs a function of positioning the inner terminal 60 inserted into the terminal receiving chamber 11U of the upper step from the opening 14 for upper step side terminal reception in a position connected to a connection mating terminal inserted from the mating terminal insertion port 12, and also performs a function of making the inner terminal 60 resistant to coming out of the opening 14 for upper step side terminal reception by decreasing a gap between the connection mating terminal and an inner surface of the terminal receiving chamber 11U and using an upper end edge surface of the curved recessed part 15*b* as a hook portion.

The shield terminal 20 is a terminal connected to the exposed braid 41*b* of the shielded electric wire 40 while covering an outer periphery of the inner housing 10, and is formed in a predetermined shape, for example, by pressing a plate-shaped metal member.

As shown in FIG. 1, this shield terminal 20 is configured to have a shield terminal body 21 forming a portion for covering the outer periphery of the inner housing 10, and a shield crimp part 22 forming a portion crimped to the braid 41*b* of the shielded electric wire 40.

The shield terminal body 21 has substantially a rectangular tube shape corresponding to an outer shell of the inner housing 10 and is configured to cover the outer periphery of the inner housing 10 and lock the inner housing 10 in a predetermined position of the tube.

The shield crimp part 22 is coupled to the shield terminal body 21 at a bottom wall through a coupling part continuous with a bottom wall of the shield terminal body 21, and is formed so as to erect a pair of barrel pieces 22*a*, 22*a* from both sides of the bottom wall.

This pair of barrel pieces 22*a*, 22*a* is crimped to the exposed braid 41*b* of the shielded electric wire 40.

The outer housing 30 is made of an insulating resin material, and is configured to have a hood part 31 formed in a hood shape so as to surround an outer periphery of the shield terminal 20 attached to the inner housing 10, a seal member holding receiving part 32 for holding and receiving the rubber stopper 36 for sealing the electric wire pullout port 30*a* so as to be able to be made waterproof, a holder lock part 33 for locking a holder 35, and a lock arm part 34 locked in a locked part 121 formed on a connector part 120 described below of the connection other connector 110.

Such an outer housing 30 is constructed so that the inner housing 10 with the shield terminal 20 attached is received inside the hood part 31 and the holder 35 is mounted from the side of the electric wire pullout port 30*a* with the rubber stopper 36 set in seal member holding receiving part 32.

Here, the connection other connector 110 will be described.

As shown in FIG. 2, the connection other connector 110 is configured to have a connector part 120 forming a portion connector-fitted into the shield connector 1, and a camera receiving part 130 forming a portion for receiving a camera functional component (not shown).

The connector part 120 has a tube shape, and plural connection mating terminals (not shown) connected to the inner terminals 60 are held and received with the top end facing to a fitting port. In addition, the connection mating terminal is a male terminal corresponding to the female inner terminal 60.

This connector part 120 is provided with the locked part 121 in which the lock arm part 34 of the outer housing 30 is locked.

The camera receiving part 130 is configured to have a component attachment part 131 for attaching the camera functional component, and a camera cover part 132 for surrounding the component attachment part 131 including a lens.

Next, a procedure for assembling the shield connector will be described using FIGS. 5 to 10.

Figure 5A:
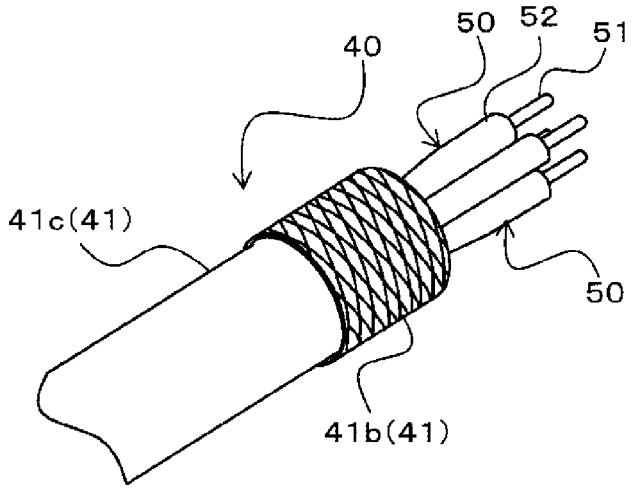
FIG. 5A is a perspective view of the shielded electric wire in a state in which each coating material of a distal end is removed and four electric wires are exposed with a braid folded back on an outer periphery of an insulating coating material and a conductor part of a distal end of each of the electric wires is exposed.
Figure 5B:
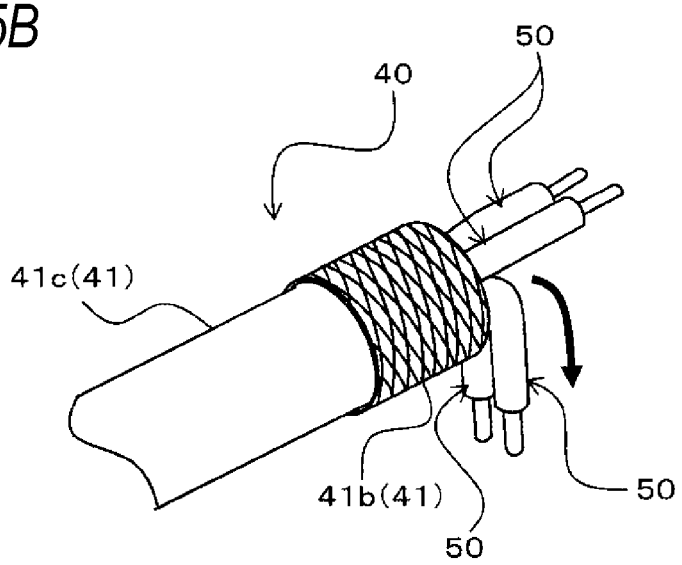
FIG. 5B is a perspective view of the shielded electric wire in a state in which two of the four electric wires exposed to the distal end are downwardly bent.
Figure 6A:
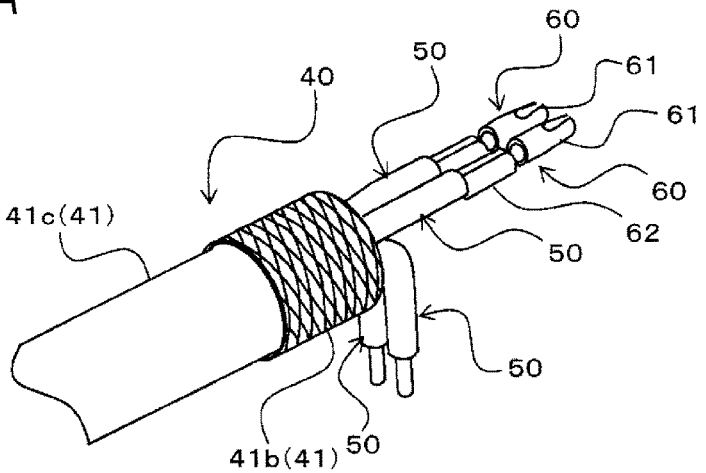
FIG. 6A is a perspective view of the shielded electric wire in a state in which the inner terminals are attached to distal ends of the two electric wires which are not downwardly bent.
Figure 6B:
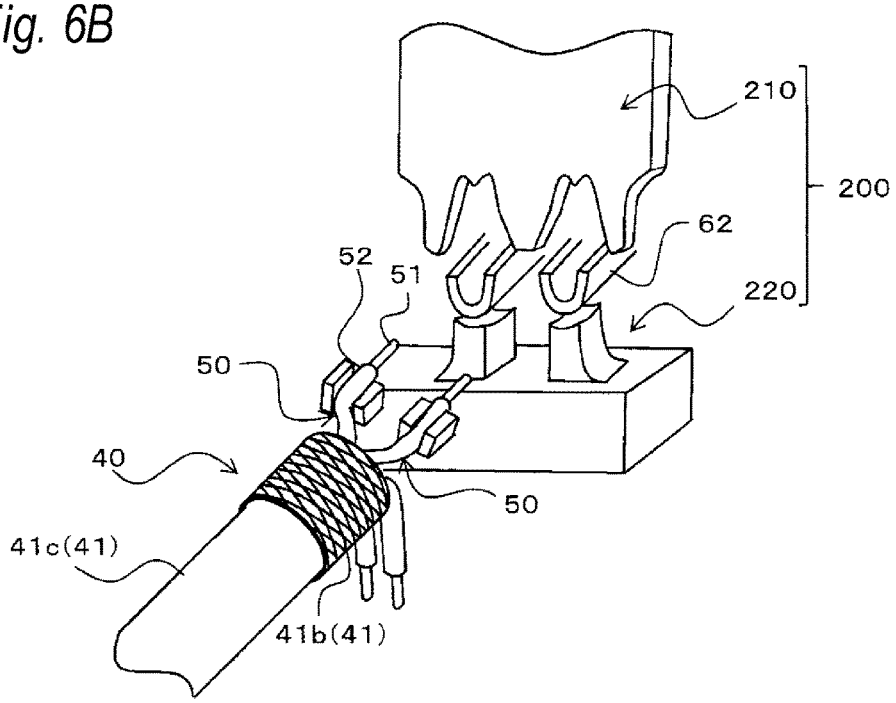
FIG. 6B is a view describing that the inner terminals are attached to the distal ends of the two electric wires by a metal mold.
Figure 7A:
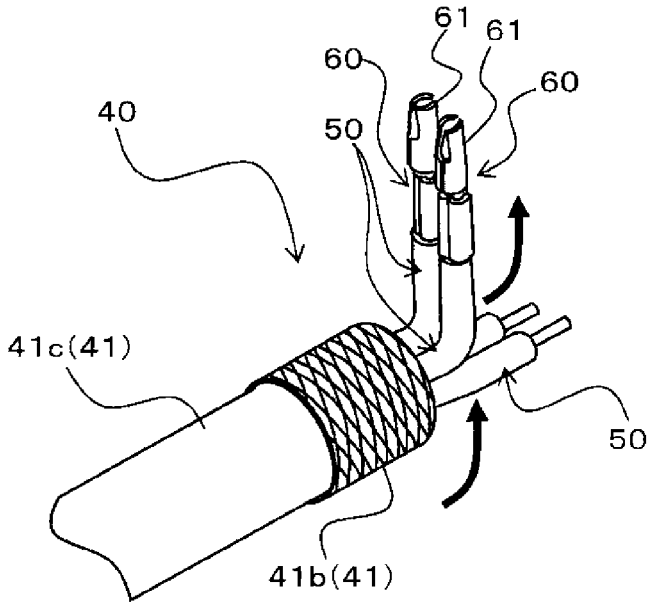
FIG. 7A is a perspective view of the shielded electric wire in a state in which the two electric wires to which the inner terminals are attached are upwardly bent and also the two downwardly bent electric wires are returned to an unbent state.
Figure 7B:
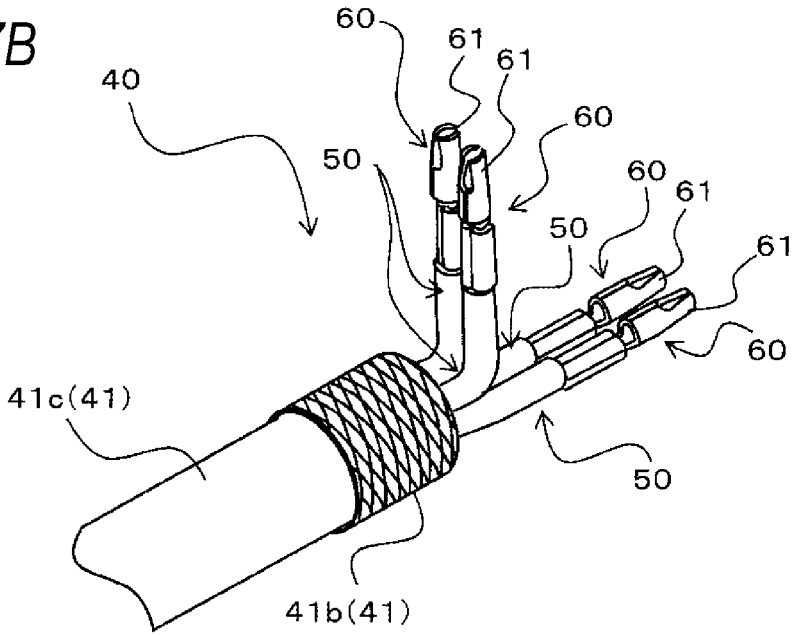
FIG. 7B is a perspective view of the shielded electric wire in a state in which the inner terminals are attached to the distal ends of the two electric wires returned to the unbent state.
Figure 8A:
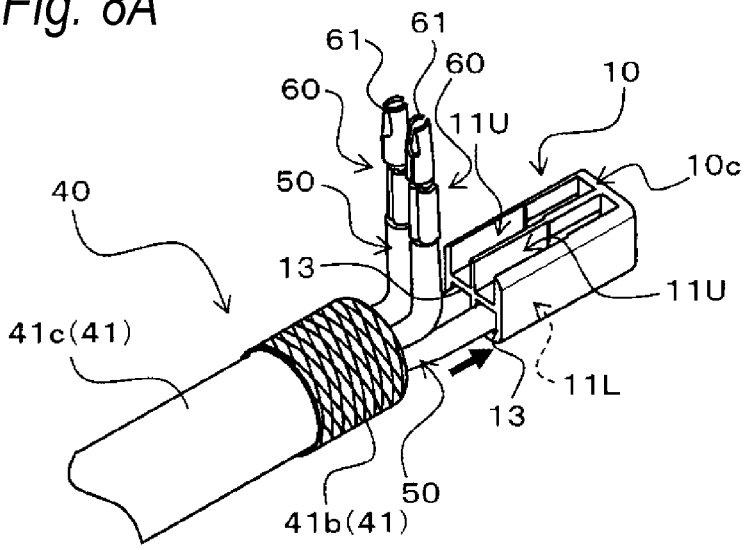
FIG. 8A is a view showing a state in which the inner terminals are received in terminal receiving chambers of a lower step.
Figure 8B:
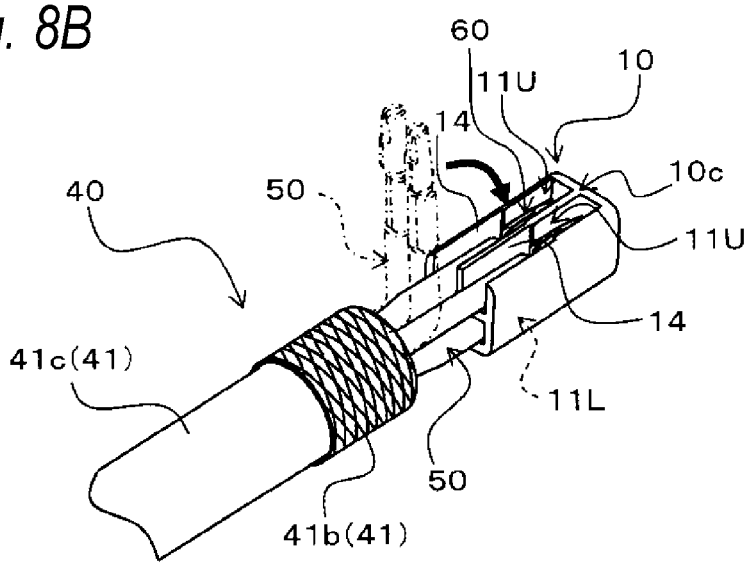
FIG. 8B is a view showing a state in which the inner terminals are received in terminal receiving chambers of an upper step to thereby receive all the inner terminals in the corresponding terminal receiving chambers.
Figure 9A:
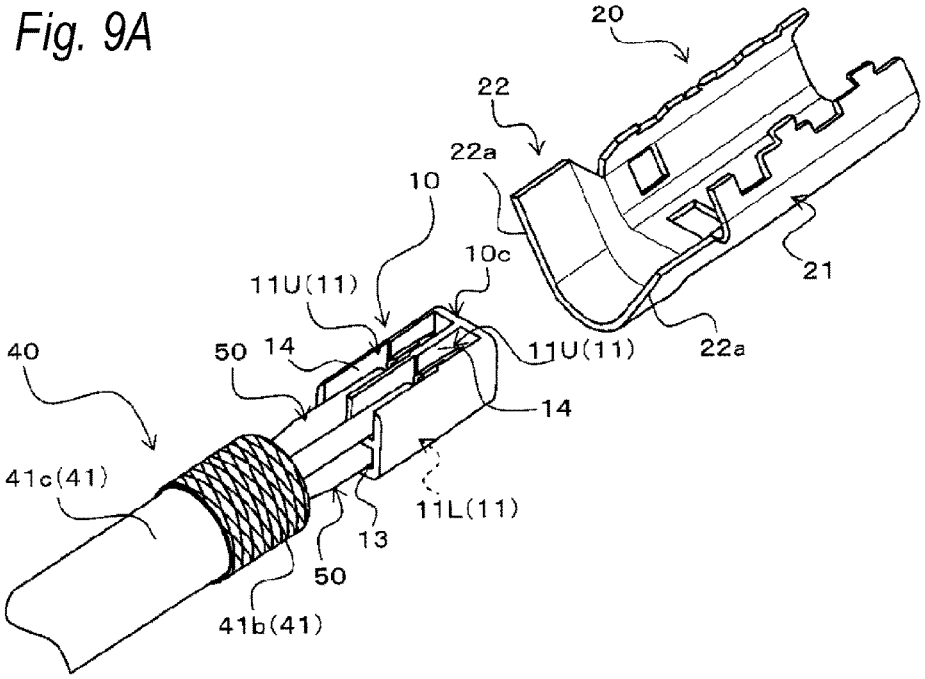
FIG. 9A is a view describing a situation in which a shield terminal is to be attached to the inner housing.
Figure 9B:
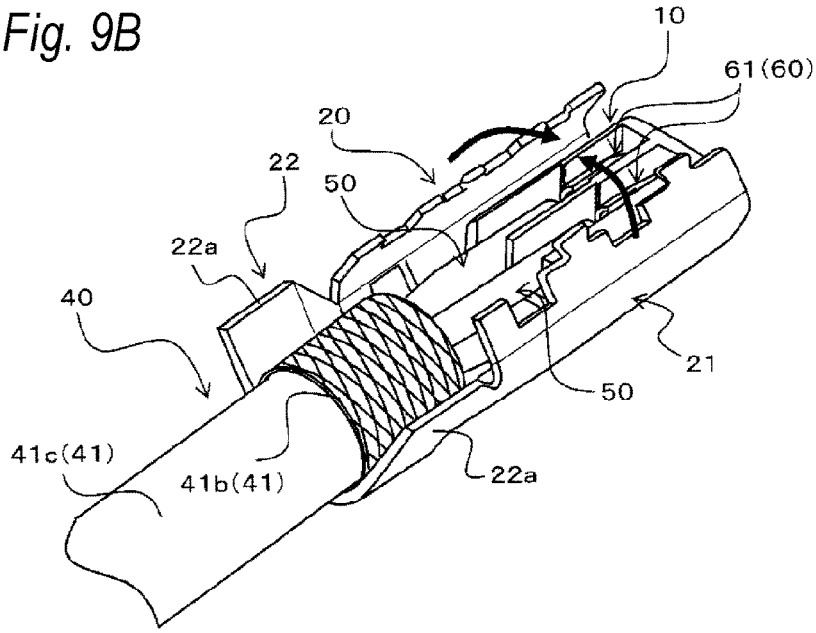
FIG. 9B is a view showing a state in which the inner housing is to be covered by a shield terminal body of the shield terminal.
Figure 10:
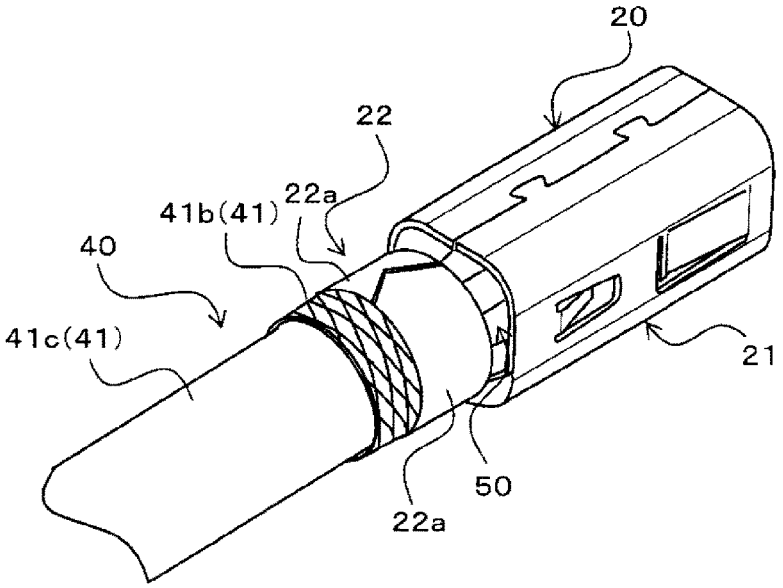
FIG. 10 is a view showing a state in which the shield terminal has been attached to the inner housing.

FIG. 5A is a perspective view of the shielded electric wire 40 in a state in which each of the coating materials 41 of a distal end is removed and the four electric wires 50 are exposed with the braid 41*b* folded back on an outer periphery of the insulating coating material 41*c* and the conductor part 51 of a distal end of each of the electric wires 50 is exposed, and FIG. 5B is a perspective view of the shielded electric wire 40 in a state in which two of the four electric wires 50 exposed to the distal end are downwardly bent. FIG. 6A is a perspective view of the shielded electric wire 40 in a state in which the inner terminals 60 are attached to the distal ends of the two electric wires 50 which are not downwardly bent, and FIG. 6B is a view describing that the inner terminals 60 are attached to the distal ends of the two electric wires 50 by a crimping apparatus 200. FIG. 7A is a perspective view of the shielded electric wire 40 in a state in which the two electric wires 50 to which the inner terminals 60 are attached are upwardly bent and also the two downwardly bent electric wires 50 are returned to an unbent state, and FIG. 7B is a perspective view of the shielded electric wire 40 in a state in which the inner terminals 60 are attached to the distal ends of the two electric wires 50 returned to the unbent state. FIG. 8A is a view showing a state in which the inner terminals 60 are received in the terminal receiving chambers 11L of the lower step, and FIG. 8B is a view showing a state in which the inner terminals 60 are received in the terminal receiving chambers 11U of the upper step to thereby receive all the inner terminals 60 in the corresponding terminal receiving chambers 11. FIG. 9A is a view describing a situation in which the shield terminal 20 is to be attached to the inner housing 10, and FIG. 9B is a view showing a state in which the inner housing 10 is to be covered by a shield terminal body 21 of the shield terminal 20. FIG. 10 is a view showing a state in which the shield terminal has been attached to the inner housing 10.

Assembling work of this shield connector 1 is done by, for example, an automatic machine (not shown).

As preprocessing of this assembling work, the shielded electric wire 40 is in a state in which each of the coating materials 41 of a distal end is removed and the four electric wires 50 are exposed with the braid 41*b* folded back on an outer periphery of the insulating coating material 41*c* and the conductor part 51 of a distal end of each of the electric wires 50 is exposed (see FIG. 5A).

In addition, this preprocessing may be performed by the automatic machine.

First, the automatic machine downwardly bends two of the four electric wires 50 exposed to the distal end of the shielded electric wire 40 (see FIG. 5B).

Here, the two electric wires 50 are bent in the same direction and in only one place, with the result that the electric wire 50 can easily be bent without performing a complicated step even when the length of the portion in which the electric wire 50 is exposed from the coating material 41 is short.

Next, the automatic machine attaches the inner terminals 60 to the distal ends of the two electric wires 50 which are not downwardly bent (see FIG. 6A).

When the inner terminals 60 are attached to the distal ends of the two electric wires 50, the crimp parts 62 of the inner terminals 60 are crimped to the electric wires 50 by the crimping apparatus 200 called a crimper 210 and an anvil 220.

Here, the two electric wires 50 are aligned at a pitch corresponding to the crimping apparatus 200, and the inner terminals 60 are simultaneously crimped to the electric wires 50 (see FIG. 6B).

When the inner terminals 60 are crimped to the distal ends of the two electric wires 50 in this manner, the two remaining electric wires 50 to which the inner terminals 60 are not crimped are downwardly bent, with the result that the processing is not hindered.

In addition, the two inner terminals 60, respectively attached to the distal ends of the two electric wires 50 in this step, of the four inner terminals 60 received in the four terminal receiving chambers 11 of the two upper and lower steps are received in the two terminal receiving chambers 11U of the upper step.

Then, the automatic machine upwardly bends the two electric wires 50 with the inner terminals 60 attached, and also returns the two downwardly bent electric wires 50 to an unbent state (see FIG. 7A).

Here, the two electric wires 50, to which the inner terminals 60 received in the terminal receiving chambers 11U of the upper step of the inner housing 10 are attached, of the four electric wires 50 are upwardly bent.

Also, the two electric wires 50, to which the inner terminals 60 received in the terminal receiving chambers 11L of the lower step of the inner housing 10 are attached, of the four electric wires 50 are returned to the unbent straight state.

Then, the automatic machine attaches the inner terminals 60 to the distal ends of the two electric wires 50 returned to the unbent state (see FIG. 7B).

Here, in a manner similar to the two electric wires 50 to which the inner terminals 60 are already attached, the inner terminals 60 are attached to the two electric wires 50.

When the inner terminals 60 are crimped to the distal ends of the two electric wires 50 in this manner, the two remaining electric wires 50 to which the inner terminals 60 are already crimped are upwardly bent, with the result that the processing is not hindered.

In addition, the two inner terminals 60 respectively attached to the distal ends of the two electric wires 50 herein are received in the two terminal receiving chambers 11L of the lower step.

Then, the automatic machine receives the inner terminals 60 in the terminal receiving chambers 11L of the lower step by inserting the inner terminals 60 received in the terminal receiving chambers 11L of the lower step from the terminal insertion ports 13 (see FIG. 8A).

Here, the two electric wires 50 in which the inner terminals 60 received in the terminal receiving chambers 11L of the lower step are attached to the distal ends are returned to the unbent straight state. As a result, the inner terminals 60 received in the terminal receiving chambers 11L of the lower step are easily received in the terminal receiving chambers 11L from the terminal insertion ports 13.

Also, since the mating terminal connecting part 61 of the inner terminal 60 has a cylindrical shape, the inner terminal 60 can be inserted into the terminal receiving chamber 11L from the terminal insertion port 13 without considering directionality.

Then, the automatic machine receives the inner terminals 60 in the terminal receiving chambers 11U of the upper step from the openings 14 for upper step side terminal reception while returning the upwardly bent electric wires 50 from an upwardly bent state to an unbent straight state (see FIG. 8B).

Here, the opening 14 for upper step side terminal reception is opened from one end face used as the side of the terminal insertion port 13 of the inner terminal 60 in the terminal receiving chamber 11L of the lower step to the front end wall 10*c* forming the other opposed end face so that the inner terminal 60 can be internally received.

As a result, by returning the electric wire 50 from the upwardly bent state to the unbent straight state, the inner terminal 60 is easily received in the terminal receiving chamber 11U from the upper surface side of the inner housing 10 through the opening 14 for upper step side terminal reception.

Also, since the mating terminal connecting part 61 of the inner terminal 60 has the cylindrical shape, the inner terminal 60 can be inserted into the terminal receiving chamber 11U from the opening 14 for upper step side terminal reception without considering directionality.

Then, the automatic machine attaches the shield terminal 20 to the inner housing 10 (see FIGS. 9A to 10).

Here, each of the openings 14 for upper step side terminal reception is closed by covering an outer periphery of the inner housing 10 with the shield terminal body 21.

Also, the shield crimp part 22 is crimped to the exposed braid 41*b* of the shielded electric wire 40.

Thereafter, the inner housing 10 with the shield terminal 20 attached is incorporated into the outer housing 30, and the rubber stopper 36 is fixed to the electric wire pullout port 30*a* of the outer housing 30 by the holder 35 to thereby complete the shield connector 1.

In the shield connector 1 according to the embodiment of the invention, in a state in which the electric wire 50 to which the inner terminal 60 received in the terminal receiving chamber 11U of the upper step is attached is upwardly bent, the inner terminal 60 can be received in the terminal receiving chamber 11L of the lower step from the terminal insertion port 13 of one end face of the inner housing 10 with the electric wire 50 set in substantially a straight state, and after the inner terminal 60 is received in the terminal receiving chamber 11L of the lower step, the inner terminal 60 can be received in the terminal receiving chamber 11U of the upper step from the opening 14 for upper step side terminal reception while returning the upwardly bent electric wire 50 to the unbent straight state, with the result that the inner terminal 60 can be received in the corresponding terminal receiving chamber 11L of the lower step in a state in which each electric wire 50 to which the inner terminal 60 received in the terminal receiving chamber 11L of the lower step is attached is in a straight state without performing a complicated step even when the length of the portion in which the electric wire 50 is exposed from the coating material 41 is short, and the inner terminal 60 can be received in the corresponding terminal receiving chamber 11U of the upper step by only bending each electric wire 50 to which the inner terminal 60 received in the terminal receiving chamber 11U of the upper step is attached in the same direction and in only one place. As a result, an assembling step can easily be automated.

Also, in the shield connector 1 according to the embodiment of the invention, the mating terminal connecting part 61 of the inner terminal 60 has the cylindrical shape, with the result that the plural inner terminal 60 can be received in the corresponding terminal receiving chambers 11 without considering directionality of the mating terminal connecting part 61 in an outer peripheral direction. As a result, the assembling step can easily be automated.

Also, in the method for assembling the shield connector according to the embodiment of the invention, in a state in which the electric wire 50, to which the inner terminal received in the terminal receiving chamber 11U of the upper step of the inner housing 10 is attached, of the plural electric wires 50 is upwardly bent in an electric wire bending step, the inner terminal 60 attached to the electric wire 50 in a straight state without being upwardly bent can be inserted from the terminal insertion port 13 to thereby receive the inner terminal 60 in the terminal receiving chamber 11L of the lower step in a lower step terminal receiving step, and the inner terminal 60 can be received in the terminal receiving chamber 11U of the upper step from the opening 14 for upper step side terminal reception while returning the electric wire 50 upwardly bent in the electric wire bending step from an upwardly bent state to an unbent straight state in an upper step terminal receiving step, with the result that the plural inner terminals 60 can be received in the corresponding terminal receiving chambers by only bending each electric wire 50 to which the inner terminal 60 received in the terminal receiving chamber 11U of the upper step is attached in the same direction and in only one place without performing a complicated step even when the length of the portion in which the electric wire 50 is exposed from the coating material 41 is short. As a result, an assembling step can easily be automated.

Also, in the method for assembling the shield connector according to the embodiment of the invention, a series of operations of attaching the inner terminals to the distal ends of the plural electric wires 50 and respectively receiving the plural inner terminals 60 in the corresponding terminal receiving chambers 11 can be performed by only repeating an operation of bending each electric wire 50 in the same direction and in only one place, the operation in which the electric wire 50 to which the inner terminal 60 received in the terminal receiving chamber 11L of the lower step is attached is downwardly bent in an upper step terminal attaching step, and the electric wire 50 to which the inner terminal 60 received in the terminal receiving chamber 11U of the upper step is attached is upwardly bent in the electric wire bending step, and the downwardly bent electric wire 50 is returned to the straight state in a lower step terminal attaching step, and the upwardly bent electric wire 50 is returned from the upwardly bent state to the unbent straight state in the upper step terminal receiving step. As a result, the assembling step can easily be automated.

In addition, the shield connector 1 according to the embodiment of the invention illustrates the shield connector configured to have the inner housing 10 provided with the four terminal receiving chambers 11 in two upper and lower steps, but the number of terminal receiving chambers 11 is not limited to four, and may be numbers other than four as long as the terminal receiving chambers 11 are formed in two upper and lower steps.

Also, the shield connector 1 according to the embodiment of the invention illustrates the case where the mating terminal connecting part 61 of the inner terminal 60 has the cylindrical shape, but the shape is not limited to this cylindrical shape, and may be other shapes. For example, the mating terminal connecting part 61 may have a rectangular tube shape.

In view of the above, according to an aspect of the invention, there is provided the shield connector and the method for assembling the shield connector described as (i) to (vi) below.

(i) A shield connector (1), including:

an inner housing (10) provided with a first terminal receiving chamber (11U) and a second terminal receiving chamber (11L) which are configured to respectively receive inner terminals (60) attached to ends of a plurality of wires (50) bundled into a shielded electric wire (40); and a shield terminal (20) incorporating the inner housing (10) therein, wherein the first terminal receiving chamber (11U) is provided with an opening (14) which is opened to a side opposite to a side where the second terminal receiving chamber (11L) is placed, and the opening (14) is opened, from one end of the first terminal receiving chamber (11U) at a side of a terminal insertion port (13) of the second terminal receiving chamber (11U) through which one of the inner terminals (60) is inserted, to a wall (10*c*) at the other end of the first terminal receiving chamber (11U), so that another one of the inner terminals (60) is received in the first terminal receiving chamber (11U) through the opening (14).

(ii) The shield connector (1) as set forth in the (i) above, wherein the first terminal receiving chamber (11U) and the second terminal receiving chamber (11L) are configured to receive the inner terminals (60) each of which includes a mating terminal connecting part (61) having a cylindrical shape and configured to be connected to an mating terminal.

(iii) The shield connector (1) as set forth in the (i) above, wherein the inner housing (10) includes an upper step provided with the first terminal receiving chamber (11U) and a lower step provided with the second terminal receiving chamber (11L), a plurality of upper terminal receiving chambers (11U) including the first terminal receiving chamber (11U) are provided in the upper step, a plurality of lower terminal receiving chambers (11L) including the second terminal receiving chamber (11L) are provided in the lower step, and each of the upper terminal receiving chambers (11U) is provided with the opening (14).

(iv) A method for assembling a shield connector (1), wherein the shield connector (1) includes:

an inner housing (10) provided with a first terminal receiving chamber (11U) and a second terminal receiving chamber (11L) which are configured to respectively receive inner terminals (60) attached to ends of a plurality of wires (50) bundled into a shielded electric wire (40); and a shield terminal (20) incorporating the inner housing (10) therein, wherein the first terminal receiving chamber (11U) is provided with an opening (14) which is opened to a side opposite to a side where the second terminal receiving chamber (11L) is placed, and the opening (14) is opened, from one end of the first terminal receiving chamber (11U) at a side of a terminal insertion port (13) of the second terminal receiving chamber (11L) through which one of the inner terminals (60) is inserted, to a wall (10*c*) at the other end of the first terminal receiving chamber (11U), the method for assembling the shield connector (1) including:

bending a first one of the wires (50) from a straight state;

inserting the one of the inner terminals (60) attached to a second one of the wires (50) from the terminal insertion port (13) so that the one of the inner terminals (60) is received in the second terminal receiving chamber (11L) in a state that the first one of the wires (50) is bent by the bending; and deforming the first one of the wires (50) into the straight state from the state that the first one of the wires (50) is bent, while inserting another one of the inner terminals (60) attached to the first one of the wires (50) into the first terminal receiving chamber (11U) through the opening (14), in a state that the one of the inner terminals (60) is received in the second terminal receiving chamber (11L).

(v) The method for assembling the shield connector (1) as set forth in the (iv) above, further comprising:

before the bending of the first one of the wires (50), bending the second one of the wires (50) from a straight state while maintaining the first one of the wires (50) in straight, and attaching another one of the inner terminals (60) to the first one of the wires (50) in a state that the second one of the wires (50) is bent; and after the bending of the first one of the wires (50) and before the inserting of the one of the inner terminals (60), deforming the second one of the wires (50) into the straight state from a state that the second one of the wires (50) is bent, and attaching the one of the inner terminals (60) to the second one of the wires (50) in a state that the second one of the wires (50) is in the straight state.

(vi) The method for assembling the shield connector (1) as set forth in the (iv) above, further comprising:

inserting the inner housing (10) into the shield terminal (20) in a state that all of the inner terminals (60) are received in the inner housing (10).

In the shield connector according to the invention, in a state in which the electric wire to which the inner terminal received in the terminal receiving chamber of the upper step is attached is upwardly bent, the inner terminal can be received in the terminal receiving chamber of the lower step from the terminal insertion port of one end face of the inner housing with the electric wire set in substantially a straight state, and after the inner terminal is received in the terminal receiving chamber of the lower step, the inner terminal can be received in the terminal receiving chamber of the upper step from the opening for upper step side terminal reception while returning the upwardly bent electric wire to the unbent straight state, with the result that the inner terminal can be received in the corresponding terminal receiving chamber of the lower step in a state in which each electric wire to which the inner terminal received in the terminal receiving chamber of the lower step is attached is in a straight state without performing a complicated step even when the length of the portion in which the electric wire is exposed from the coating material is short, and the inner terminal can be received in the corresponding terminal receiving chamber of the upper step by only bending each electric wire to which the inner terminal received in the terminal receiving chamber of the upper step is attached in the same direction and in only one place. As a result, an assembling step can easily be automated.

In the shield connector according to the invention, the mating terminal connecting part of the inner terminal has the cylindrical shape, with the result that the plural inner terminal can be received in the corresponding terminal receiving chambers without considering directionality of the mating terminal connecting part in an outer peripheral direction. As a result, the assembling step can easily be automated.

In the method for assembling the shield connector of the invention, in a state in which the electric wire, to which the inner terminal received in the terminal receiving chamber of the upper step of the inner housing is attached, of the plural electric wires is upwardly bent in the electric wire bending step, the inner terminal attached to the electric wire in a straight state without being upwardly bent can be inserted from the terminal insertion port to thereby receive the inner terminal in the terminal receiving chamber of the lower step in the lower step terminal receiving step, and the inner terminal can be received in the terminal receiving chamber of the upper step from the opening for upper step side terminal reception while returning the electric wire upwardly bent in the electric wire bending step from the upwardly bent state to the unbent straight state in the upper step terminal receiving step, with the result that the plural inner terminals can be received in the corresponding terminal receiving chambers by only bending each electric wire to which the inner terminal received in the terminal receiving chamber of the upper step is attached in the same direction and in only one place without performing a complicated step even when the length of the portion in which the electric wire is exposed from the coating material is short. As a result, an assembling step can easily be automated.

In the method for assembling the shield connector of the invention, a series of operations of attaching the inner terminals to the distal ends of the plural electric wires and respectively receiving the plural inner terminals in the corresponding terminal receiving chambers can be performed by only repeating an operation of bending each electric wire in the same direction and in only one place, the operation in which the electric wire to which the inner terminal received in the terminal receiving chamber of the lower step is attached is downwardly bent in the upper step terminal attaching step, and the electric wire to which the inner terminal received in the terminal receiving chamber of the upper step is attached is upwardly bent in the electric wire bending step, and the downwardly bent electric wire is returned to the straight state in the lower step terminal attaching step, and the upwardly bent electric wire is returned from the upwardly bent state to the unbent straight state in the upper step terminal receiving step. As a result, the assembling step can easily be automated.

The invention implemented by the present inventor has been described above concretely based on the embodiment of the invention described above, but the invention is not limited to the embodiment of the invention described above, and various changes can be made without departing from the gist of the invention.

What is claimed is:

1. A shield connector, comprising:

an inner housing provided with a first terminal receiving chamber and a second terminal receiving chamber which are configured to respectively receive inner terminals attached to ends of a plurality of wires bundled into a shielded electric wire; and a shield terminal incorporating the inner housing therein, wherein the first terminal receiving chamber is provided with an opening which is opened to a side opposite to a side where the second terminal receiving chamber is placed, and the opening is opened, from one end of the first terminal receiving chamber at a side of a terminal insertion port of the second terminal receiving chamber through which one of the inner terminals is inserted, to a wall at the other end of the first terminal receiving chamber, so that another one of the inner terminals is received in the first terminal receiving chamber through the opening.

2. The shield connector as set forth in claim 1, wherein the first terminal receiving chamber and the second terminal receiving chamber are configured to receive the inner terminals each of which includes a mating terminal connecting part having a cylindrical shape and configured to be connected to an mating terminal.

3. The shield connector as set forth in claim 1, wherein the inner housing includes an upper step provided with the first terminal receiving chamber and a lower step provided with the second terminal receiving chamber, a plurality of upper terminal receiving chambers including the first terminal receiving chamber are provided in the upper step, a plurality of lower terminal receiving chambers including the second terminal receiving chamber are provided in the lower step, and each of the upper terminal receiving chambers is provided with the opening.

4. A method for assembling a shield connector, wherein the shield connector includes:

an inner housing provided with a first terminal receiving chamber and a second terminal receiving chamber which are configured to respectively receive inner terminals attached to ends of a plurality of wires bundled into a shielded electric wire; and a shield terminal incorporating the inner housing therein, wherein the first terminal receiving chamber is provided with an opening which is opened to a side opposite to a side where the second terminal receiving chamber is placed, and the opening is opened, from one end of the first terminal receiving chamber at a side of a terminal insertion port of the second terminal receiving chamber through which one of the inner terminals is inserted, to a wall at the other end of the first terminal receiving chamber, the method for assembling the shield connector comprising:

bending a first one of the wires from a straight state;

inserting the one of the inner terminals attached to a second one of the wires from the terminal insertion port so that the one of the inner terminals is received in the second terminal receiving chamber in a state that the first one of the wires is bent by the bending; and deforming the first one of the wires into the straight state from the state that the first one of the wires is bent, while inserting another one of the inner terminals attached to the first one of the wires into the first terminal receiving chamber through the opening, in a state that the one of the inner terminals is received in the second terminal receiving chamber.

5. The method for assembling the shield connector as set forth in claim 4, further comprising:

before the bending of the first one of the wires, bending the second one of the wires from a straight state while maintaining the first one of the wires in straight, and attaching another one of the inner terminals to the first one of the wires in a state that the second one of the wires is bent; and after the bending of the first one of the wires and before the inserting of the one of the inner terminals, deforming the second one of the wires into the straight state from a state that the second one of the wires is bent, and attaching the one of the inner terminals to the second one of the wires in a state that the second one of the wires is in the straight state.

6. The method for assembling the shield connector as set forth in claim 4, further comprising:

inserting the inner housing into the shield terminal in a state that all of the inner terminals are received in the inner housing.

* * * * *